US011123848B2

(12) United States Patent
Wojciechowski et al.

(10) Patent No.: US 11,123,848 B2
(45) Date of Patent: Sep. 21, 2021

(54) FASTENER REMOVAL TOOLS AND METHODS

(71) Applicant: GENERAL ELECTRIC COMPANY, Schenectady, NY (US)

(72) Inventors: Piotr Hubert Wojciechowski, Mazowieckie (PL); Szymon Perkowski, Mazowieckie (PL)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 215 days.

(21) Appl. No.: 16/067,704

(22) PCT Filed: Jan. 5, 2017

(86) PCT No.: PCT/US2017/012263
§ 371 (c)(1),
(2) Date: Jul. 2, 2018

(87) PCT Pub. No.: WO2017/123446
PCT Pub. Date: Jul. 20, 2017

(65) Prior Publication Data

US 2019/0001472 A1 Jan. 3, 2019

(30) Foreign Application Priority Data

Jan. 11, 2016 (PL) ..... P.415762

(51) Int. Cl.
*B25B 27/02* (2006.01)
*F01D 25/24* (2006.01)

(52) U.S. Cl.
CPC ..... *B25B 27/026* (2013.01); *F01D 25/246* (2013.01); *F05D 2230/70* (2013.01)

(58) Field of Classification Search
CPC ..... F01D 25/246; B25B 27/06; B25B 27/023
USPC ..... 29/252
See application file for complete search history.

(56) References Cited

U.S. PATENT DOCUMENTS 2,133,697 A * 10/1938 Hansen ..... B25B 27/24 29/214
2,507,003 A * 5/1950 Gagne ..... B25B 27/026 29/283
2,735,649 A * 2/1956 Swallert ..... B25C 11/02 254/18

(Continued)

FOREIGN PATENT DOCUMENTS

CN 101698277 A * 4/2010
CN 101927429 A * 12/2010

(Continued)

OTHER PUBLICATIONS

Machine Translation of CN103769843A (Year: 2014).*

(Continued)

*Primary Examiner* — Jacob J Cigna
*Assistant Examiner* — Michael W Hotchkiss
(74) *Attorney, Agent, or Firm* — Armstrong Teasdale LLP

(57) ABSTRACT

A fastener removal tool is provided. The fastener removal tool includes a body having a cylinder and a puller coupled to the body. The puller includes an arm for engaging an installed fastener and a piston inserted into the cylinder of the body such that, when the cylinder is pressurized, the piston is displaced within the cylinder to displace the arm relative to the body to cause removal of the fastener.

20 Claims, 5 Drawing Sheets

(56) References Cited

U.S. PATENT DOCUMENTS

| | | | | | |
|---|---|---|---|---|---|
| 2,874,933 | A * | 2/1959 | Feucht | E01C 23/05 | 254/18 |
| 2,883,741 | A * | 4/1959 | Yerkes | B25B 27/026 | 29/252 |
| 4,078,766 | A * | 3/1978 | Saurwein | B25C 11/02 | 254/18 |
| 4,429,857 | A * | 2/1984 | Ferguson | B25B 27/026 | 254/18 |
| 4,542,570 | A * | 9/1985 | Prince | B25B 27/064 | 29/252 |
| 4,995,158 | A * | 2/1991 | Howell | B23P 19/04 | 29/252 |
| 5,129,133 | A * | 7/1992 | Reesor | B25B 27/026 | 29/252 |
| 5,701,649 | A * | 12/1997 | Reesor | B25B 27/023 | 29/252 |
| 6,113,073 | A * | 9/2000 | Lefavour | E01B 29/26 | 254/18 |
| 6,526,641 | B1 * | 3/2003 | Latham | B25B 27/026 | 254/18 |
| 6,978,527 | B2 * | 12/2005 | Oser | B25B 27/0035 | 29/252 |
| 7,658,368 | B2 * | 2/2010 | Laun | B25C 11/02 | 254/18 |
| 8,146,221 | B2 * | 4/2012 | Hung | B25B 27/026 | 269/24 |
| 8,910,357 | B2 * | 12/2014 | Spanos | F01D 5/005 | 29/255 |
| 9,381,602 | B2 * | 7/2016 | Holmes | B23P 19/027 | |
| 9,737,981 | B2 * | 8/2017 | Rowe | B25B 27/062 | |
| 2004/0187284 | A1 * | 9/2004 | Draggie | B21J 15/50 | 29/263 |
| 2010/0115747 | A1 * | 5/2010 | Bilstein | B25B 27/04 | 29/256 |
| 2010/0193179 | A1 * | 8/2010 | Tucken | E21B 19/08 | 166/77.1 |
| 2014/0345100 | A1 * | 11/2014 | Huang | B25B 27/023 | 29/264 |
| 2017/0102013 | A1 * | 4/2017 | Wallman | F15B 15/1457 | |

FOREIGN PATENT DOCUMENTS

| | | | | | |
|---|---|---|---|---|---|
| CN | 103769843 | A | * | 5/2014 | |
| CN | 104440026 | B | * | 11/2016 | |
| DE | 31 42 689 | A1 | | 5/1983 | |
| DE | 4204657 | C1 | * | 8/1993 | B25B 27/026 |
| EP | 0 276 553 | A1 | | 8/1988 | |
| EP | 0306737 | A2 | * | 3/1989 | F15B 7/00 |
| EP | 0 347 584 | A2 | | 12/1989 | |
| EP | 2 527 592 | A2 | | 11/2012 | |
| FR | 1390415 | A | | 2/1965 | |
| WO | 01/08852 | A1 | | 2/2001 | |

OTHER PUBLICATIONS

CN-104440026-B machine translation (Year: 2016).*
EP-0306737-A2 machine translation (Year: 1988).*
DE4204657C1 machine translation (Year: 1992).*
CN-101927429-A Machine Translation (Year: 2010).*
CN-101698277-A Machine Translation (Year: 2010).*
International Search Report and Written Opinion issued in connection with corresponding PCT Application No. PCT/US2017/012263 dated Mar. 27, 2017.
International Preliminary Report on Patentability issued in connection with corresponding PCT Application No. PCT/US2017/012263 dated Jul. 17, 2018.

* cited by examiner

FASTENER REMOVAL TOOLS AND METHODS

BACKGROUND

The field of this disclosure relates generally to fasteners and, more particularly, to tools and methods for use in removing fasteners from a turbine assembly.

Many known turbine assemblies include components that are secured in position using fasteners that are designed to be removed via a pulling action. For example, some components are assembled using dowel pins. However, fasteners of this type may only be accessible through small openings that may be difficult to reach. Moreover, the limited space may make it difficult to pull such fasteners outward.

Tools and methods for manually removing these types of fasteners are commonplace. For example, dowel pins have been known to be removed from turbine assemblies by coupling a bolt to the dowel pin and then manually turning a jacking nut on the bolt using a wrench, such that each turn of the nut results in an incremental pulling movement of the dowel pin. However, using these known tools and methods, it may be challenging, time consuming, and laborious to manually remove the fasteners that secure components in place.

BRIEF DESCRIPTION

In one aspect, a fastener removal tool is provided. The fastener removal tool includes a body having a cylinder and a puller coupled to the body. The puller includes an arm for engaging an installed fastener and a piston inserted into the cylinder of the body such that, when the cylinder is pressurized, the piston is displaced within the cylinder to displace the arm relative to the body to cause removal of the fastener.

In another aspect, a fastener removal method is provided. The method includes coupling a tool to an installed fastener, wherein the tool includes a puller having an arm that engages the fastener. The method also includes pressurizing a cylinder in a body of the tool such that a piston of the puller is displaced within the cylinder to remove the fastener via the arm of the puller.

In another aspect, a method of removing an installed fastener of a gas turbine assembly is provided. The method includes coupling a tool to the fastener within an interior space of an inner ring that supports a plurality of inlet guide vanes of the gas turbine assembly. The tool includes a puller having an arm that engages the fastener. The method also includes pressurizing a cylinder in a body of the tool such that a piston of the puller is displaced within the cylinder to remove the fastener via the arm of the puller.

DETAILED DESCRIPTION

The following detailed description illustrates fastener removal tools and methods by way of example and not by way of limitation. The description should enable one of ordinary skill in the art to make and use the tools, and practice the methods, and the description describes several embodiments of the tools and methods, including what are presently believed to be the best modes of making and using the tools, and practicing the methods. Exemplary tools are described herein as being useful when removing fasteners, such as dowel pins, from a turbine assembly. However, it is contemplated that the tools have general application to a broad range of systems in a variety of fields other than turbine assemblies.

Figure 1:
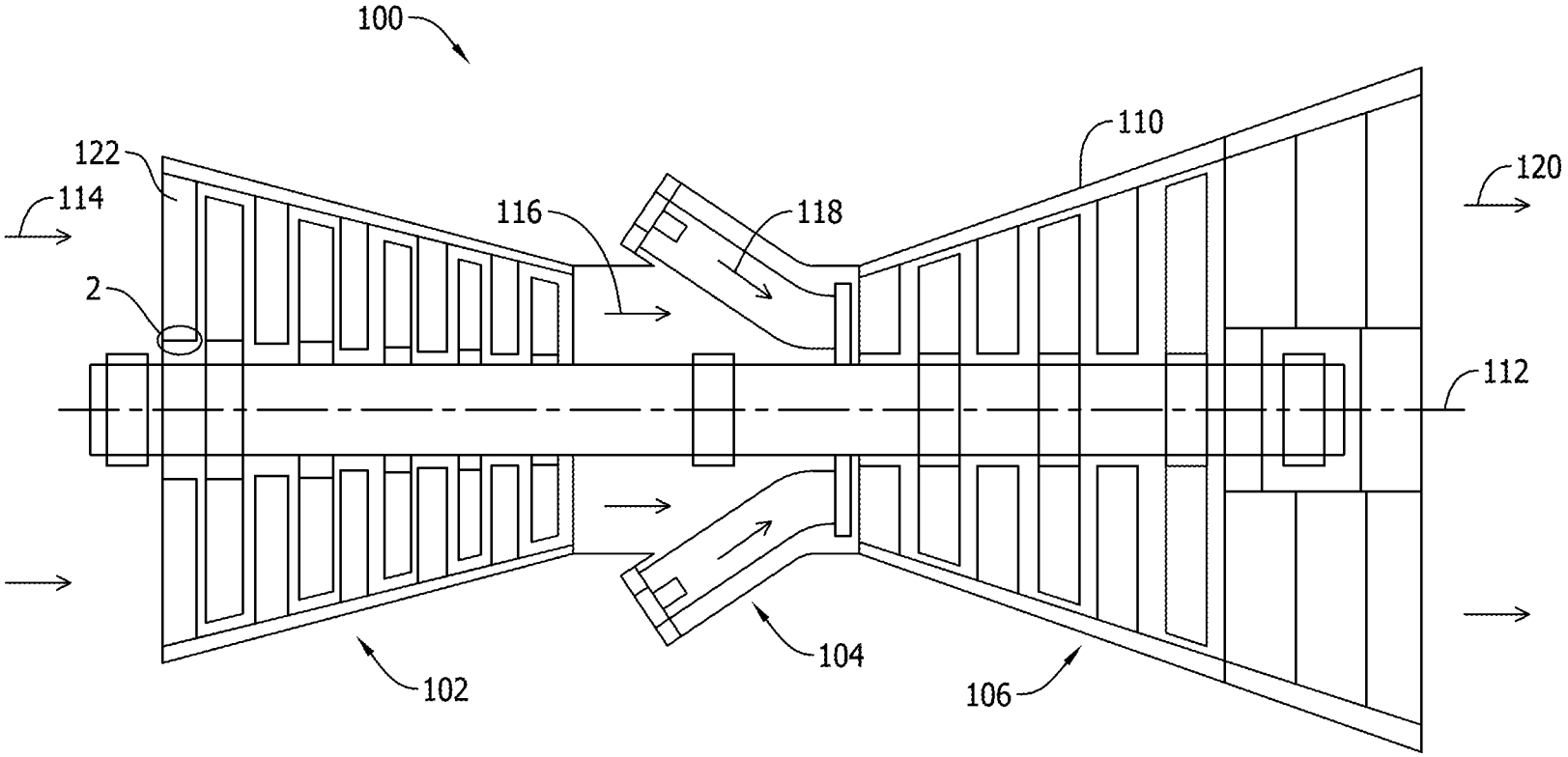
FIG. 1 is a schematic view of an exemplary turbine assembly.

FIG. 1 illustrates an exemplary turbine assembly 100. In the exemplary embodiment, turbine assembly 100 is a gas turbine assembly that includes a compressor 102, a combustor 104, and a turbine 106 coupled in serial flow communication with one another within a casing 110 and spaced along a centerline axis 112. In operation, a flow of working gas 114 (e.g., ambient air) enters compressor 102 and is compressed. A flow of compressed gas 116 is then channeled into combustor 104. Compressed gas 116 is mixed with fuel and ignited to generate a flow of combustion gases 118. Combustion gases 118 are channeled through turbine 106 and discharged from turbine assembly 100 as exhaust gases 120.

In the exemplary embodiment, turbine assembly 100 also includes a plurality of inlet guide vanes 122 that are circumferentially spaced about centerline axis 112 upstream from compressor 102. In the exemplary embodiment, inlet guide vanes 122 direct working gas 114 into compressor 102. In some embodiments, each inlet guide vane 122 may be rotatable to facilitate varying the direction of working gas 114 entering compressor 102. Turbine assembly 100 may have any suitable quantity of inlet guide vanes 122 spaced in any suitable manner about centerline axis 112.

Figure 2:
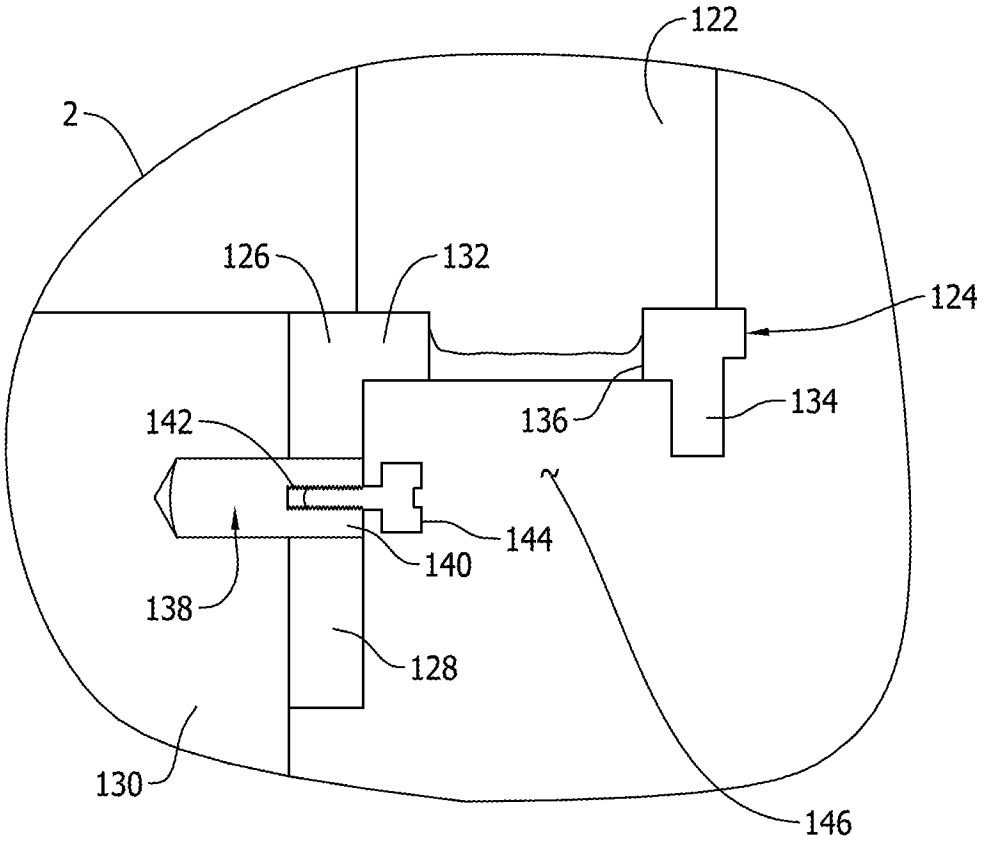
FIG. 2 is an enlarged portion of the turbine assembly shown in FIG. 1 and taken within area 2.

FIG. 2 illustrates an enlarged portion of turbine assembly 100 taken within area 2 of FIG. 1. In the exemplary embodiment, inlet guide vanes 122 are coupled to an inner ring 124 that extends circumferentially about centerline axis 112. Inner ring 124 includes a plurality of circumferentially arranged segments 126 that each include a mounting flange 128 coupled to a wall 130 of casing 110 such that mounting flange 128 extends generally radially relative to centerline axis 112. Segments 126 also include a support flange 132 extending from mounting flange 128, and a lip 134 extending generally radially inward from support flange 132. Each inlet guide vane 122 is seated in an opening 136 that extends through a support flange 132 of a respective segment 126. Accordingly, each segment 126 of inner ring 124 supports a plurality of inlet guide vanes 122 in the exemplary embodiment. In other embodiments, inner ring 124 may have any suitable cross-sectional shape, any suitable quantity of segments 126, and/or any suitable quantity of inlet guide vanes 122 per segment 126.

In the exemplary embodiment, each segment 126 is coupled to casing wall 130 via at least one fastener 138 that extends through mounting flange 128 and is installed in wall 130. By selectively removing fasteners 138 from casing wall 130, segments 126 are individually detachable from casing 110 (and from each other) to facilitate removing inlet guide vanes 122 when servicing inlet guide vanes 122 and/or compressor 102, for example. Notably, the exemplary fasteners 138 are removable from casing wall 130 via a pulling action, and are likewise insertable into casing wall 130 via a pushing action. In one embodiment, fasteners 138 may include dowel pins. In other embodiments, fasteners 138 may be of any suitable type that is insertable and/or removable in the manner described herein.

In the exemplary embodiment, each fastener 138 has a body (e.g., a dowel pin 140) that defines a threaded bore 142 therein, and a head (e.g., a shoulder head screw 144) selectively coupled within bore 142. However, because a support flange 132 and a lip 134 of a respective segment 126 extend partly around fastener 138, segment 126 defines an interior space 146 that somewhat confines fastener 138 in a manner that makes fastener 138 difficult to access. It may, therefore, be difficult to align and operate some tools such as wrenches, for example, within interior space 146 to manually remove a fastener 138 from casing 110 using, for example, a jacking nut assembly.

Figure 3:
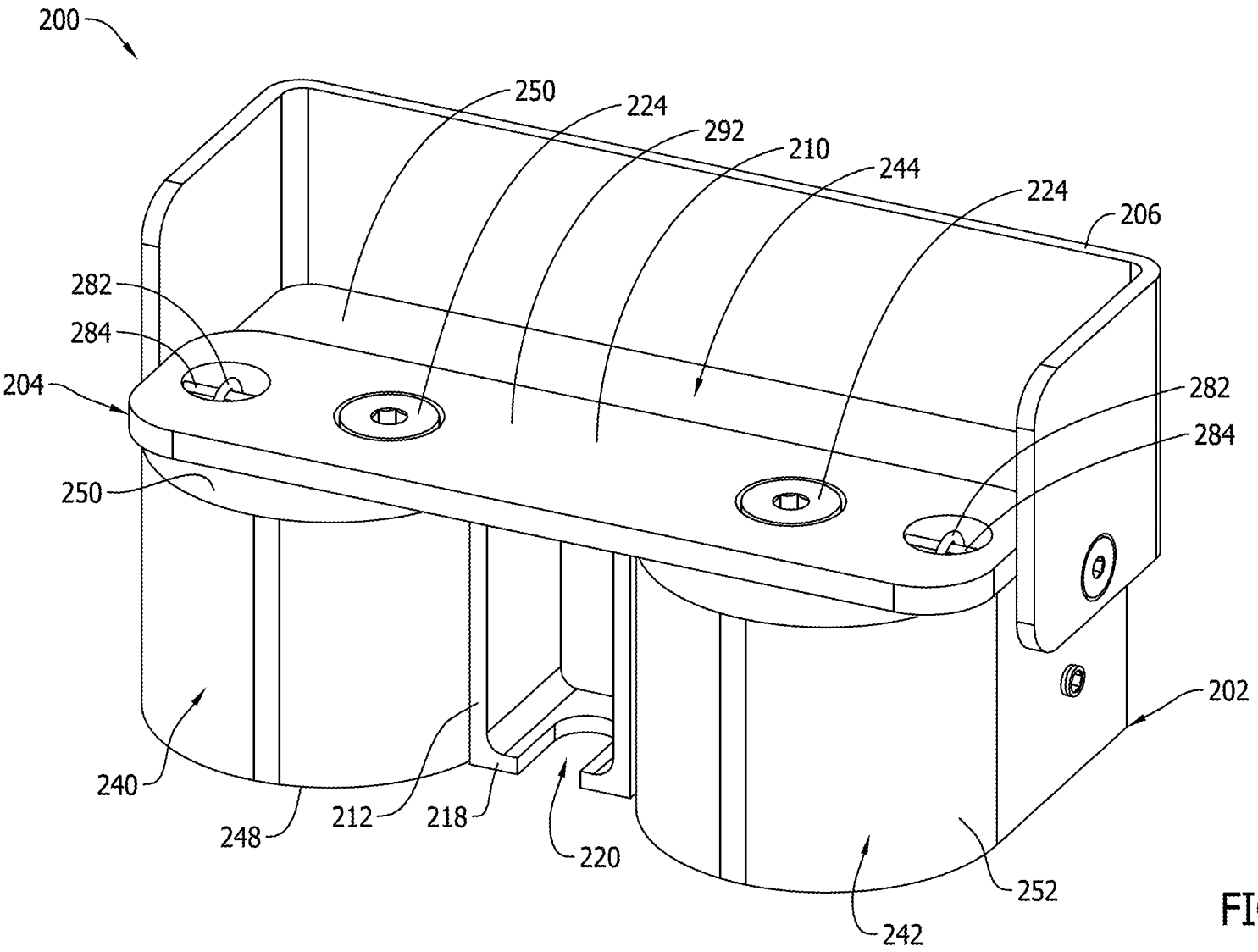
FIG. 3 is a perspective view of an exemplary tool that may be used to remove a fastener.
Figure 4:
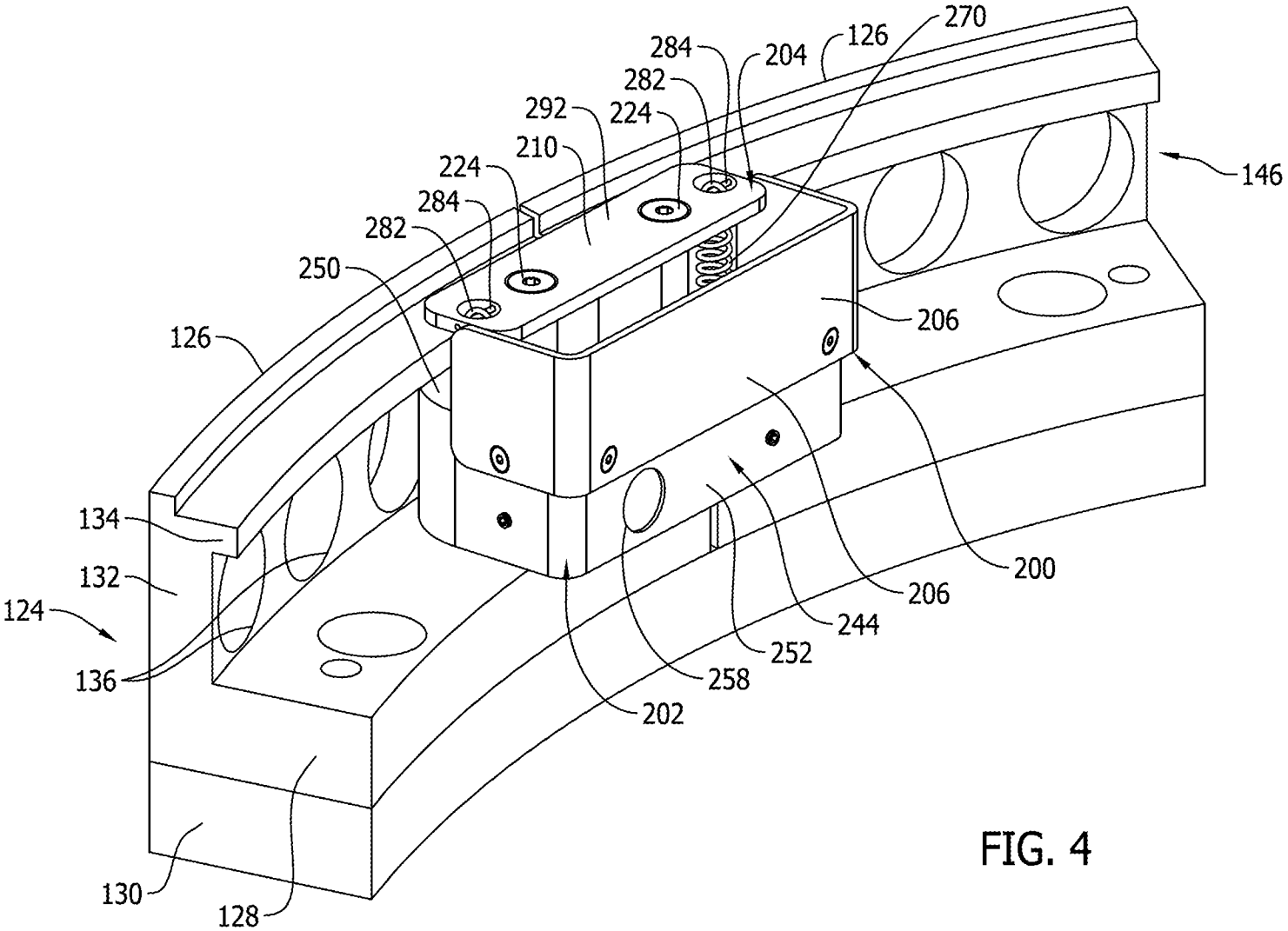
FIG. 4 is a perspective view of the tool shown in FIG. 3 during the removal of a fastener from a casing of the turbine assembly shown in FIG. 2.
Figure 5:
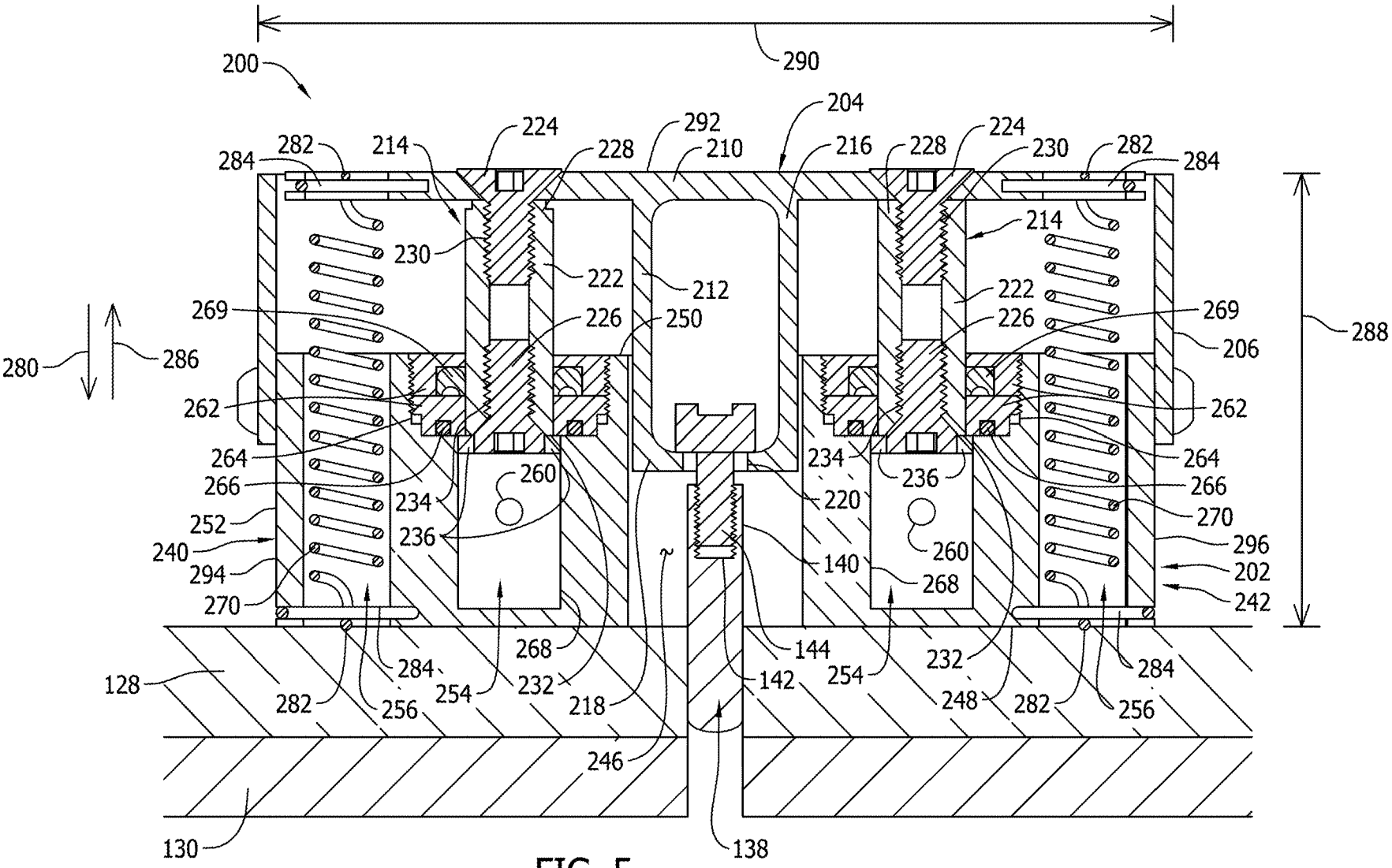
FIG. 5 is a schematic cross-sectional view of the tool shown in FIG. 4.

FIG. 3 is a perspective view of an exemplary tool 200 that may be used to remove fasteners 138 from casing 110. FIGS. 4 and 5 are perspective and schematic cross-sectional views, respectively, of tool 200 during the removal of a fastener 138 from casing 110. In the exemplary embodiment, tool 200 includes a body 202, a puller 204 slidably coupled to body 202, and a shield 206 (e.g., a finger guard) coupled to body 202 such that shield 206 at least partially surrounds puller 204. In other embodiments, tool 200 may include any suitable quantity of components assembled in any suitable manner that facilitates enabling tool 200 to function as described herein.

In the exemplary embodiment, puller 204 includes a plate 210, an arm 212 extending from plate 210, and a pair of plunger assemblies 214 extending from plate 210 on opposing sides of arm 212. As such, each plunger assembly 214 is oriented substantially parallel to arm 212. Arm 212 has a proximal end 216 that is formed integrally with plate 210, and a distal end 218 that defines an open-ended slot 220 that is sized to receive and engage shoulder head screw 144 when shoulder head screw 144 is coupled to dowel pin 140. In other embodiments, puller 204 may include any suitable structure for engaging fastener shoulder head screw 144 and/or dowel pin 140.

In the exemplary embodiment, each plunger assembly 214 includes a piston 222, a plate screw 224, and a stop screw 226. Piston 222 has a proximal end 228 that defines a threaded bore 230, and a distal end 232 that defines a threaded bore 234. Each plate screw 224 is coupled within a threaded bore 230 of a respective piston 222 to secure the respective piston 222 to plate 210. Moreover, each stop screw 226 is coupled within a threaded bore 234 of a respective piston 222. Notably, each stop screw 226 includes a plurality of peripherally spaced-apart notches 236 that facilitate fluid flow across stop screw 226 as described in more detail below. In other embodiments, each plunger assembly 214 may have any suitable configuration that facilitates enabling puller 204 to function as described herein. For example, each plunger assembly 214 may be a single-piece, integrally-molded structure, rather than having separate piston 222 and screws 224 and 226 as described above.

In the exemplary embodiment, body 202 is generally U-shaped and has a first leg member 240, a second leg member 242, and a bridge member 244 extending between first leg member 240 and second leg member 242 such that a passage 246 is defined between first leg member 240 and second leg member 242. Body 202 includes a contact face 248, a puller face 250 opposite contact face 248, and a side surface 252 extending from contact face 248 to puller face 250. A cylinder 254 and an adjacent sleeve 256 extend into each leg member 240 and 242 from puller face 250 in a substantially parallel orientation relative to passage 246. Additionally, a hose socket 258 defined in side surface 252 is in flow communication with cylinders 254 via a suitable network of internal fluid conduits 260 within body 202. Moreover, body 202 also includes a pair of bushings 262 that are each fitted (e.g., threaded) into a counterbore 264 defined about a respective one of cylinders 254. A seal 266 (e.g., an 0-ring or other suitable hydraulic seal) is positioned at the interface of each bushing 262 and its associated leg member 240 or 242.

In other embodiments, body 202 may have any suitable configuration that facilitates enabling tool 200 to function as described herein. For example, body 202 may have any suitable shape (e.g., body 202 may not be generally U-shaped), body 202 may have any suitable quantity of cylinders 254 (e.g., body 202 may have only one cylinder 254), and/or body 202 may have any suitable quantity of sleeves 256 (e.g., body 202 may not have any sleeves 256). Moreover, in some embodiments, puller 204 may have any suitable quantity of plunger assemblies 214 (e.g., puller 204 may have only one plunger assembly 214 if, for example, body 202 has only one cylinder 254).

In the exemplary embodiment, puller 204 is coupled to body 202 such that arm 212 extends into passage 246 between leg members 240 and 242, with each piston 222 extending through a respective bushing 262 and into a respective cylinder 254. As such, each corresponding stop screw 226 slides in a tight tolerance within an internal surface 268 of its respective cylinder 254, with a seal 269 (e.g., an 0-ring or other suitable hydraulic seal) positioned at the interface of each piston 222 and its associated bushing 262. Optionally, as shown in the exemplary embodiment, each bushing 262 may be split into segments to facilitate coupling seal 269 to bushing 262 (e.g., by inserting seal 269 between split segments of bushing 262).

Additionally, puller 204 is also coupled to body 202 via a pair of return springs 270 that each extend from plate 210 into a respective sleeve 256. Return springs 270 bias plate 210 towards puller face 250 of body 202 in a biasing direction 280 such that plate 210 is seated against face 250. With plate 210 seated against face 250 (as shown in FIG. 3), tool 200 is said to be in its inactivated (or resting) state such that distal end 218 (i.e., slot 220) is substantially aligned with contact face 248 of body 202. Although in the exemplary embodiment each return spring 270 is coupled to body 202 and plate 210 via a hook 282 and stake 284 engagement, return springs 270 may be coupled to body 202 and plate 210 in any suitable manner in other embodiments. Moreover, in some embodiments, puller 204 may also be pivotably (or hingedly) coupled to body 202 (e.g., if body 202 has only one cylinder 254, puller 204 may have a pivot-type connection to body 202). Other suitable mechanisms for coupling puller 204 to body 202 are also contemplated.

To detach a segment 126 of inner ring 124 from casing 110, tool 200 is initially inserted into interior space 146. More specifically, initially tool 200 is in its inactivated state (as shown in FIG. 3), such that contact face 248 slides towards support flange 132 along mounting flange 128 until slot 220 slidably engages shoulder head screw 144. After shoulder head screw 144 has been seated in slot 220, in the exemplary embodiment, a hydraulic or pneumatic pump (not shown) coupled to socket 258 is actuated to deliver a suitable working fluid (e.g., oil) through the network of internal conduits 260 and into cylinders 254. The working fluid fills (or pressurizes) cylinders 254 to displace pistons 222 (and, therefore, plate 210 and arm 212) of puller 204 away from puller face 250 of body 202 in a pulling direction 286 that is opposite biasing direction 280. As such, the fastener 138 engaged by arm 212 is pulled from wall 130 of casing 110, in which position tool 200 is said to be in its activated state (as shown in FIGS. 4 and 5).

As tool 200 transitions from its inactivated state to its activated state, the tension in return springs 270 increases such that the applied biasing force of return springs 270 on puller 204 likewise increases. After removing fastener 138 from wall 130 in the manner set forth above, the working fluid within cylinders 254 is evacuated via the pump, and return springs 270 are again permitted to automatically return puller plate 210 to being seated against body puller face 250, thereby automatically returning tool 200 to its inactivated state. With tool 200 back in its inactivated state, tool 200 is removable from interior space 146, and the fastener removal process can be repeated for other fasteners 138 as desired.

Moreover, as tool 200 transitions between its inactivated state and its activated state, working fluid within cylinders 254 flows across stop screws 226 via notches 236 to facilitate enabling stop screws 226 to travel more freely along their respective cylinders 254 during pressurization and depressurization events. Moreover, as tool 200 transitions between its inactivated state and its activated state within interior space 146, shield 206 facilitates preventing the operator's fingers from being placed on puller face 250 or plate 210, and preventing the operator's fingers from being caught between plate 210 and body 202, and/or between plate 210 and nearby structure(s) (e.g., lip 134 of inner ring 124), when cylinders 254 are pressurized and depressurized. In some embodiments, puller plate 210 may also include a slot (not shown) for engaging a shoulder head screw 144 such that tool 200 may be inserted into interior space 146 to engage and re-install an already-pulled fastener 138 via plate 210. For example, when tool 200 is in its inactivated state and is inverted, puller plate 210 may be capable of engaging and pushing (or re-inserting) an already-pulled fastener 138 back into wall 130 of casing 110 upon pressurization of cylinders 254. As such, tool 200 may be useful for both pulling installed fasteners 138, and for installing pulled fasteners 138, in some embodiments.

In the exemplary embodiment, tool 200 is sized for handheld operation (i.e., tool 200 can be coupled to, and decoupled from, an associated fastener 138 in an elevated position using only one hand). In some embodiments, tool 200 is sized for handheld operation in the sense that tool 200 can be activated (either by the operator that is holding tool 200 or by another operator) while tool 200 is being held in the elevated position using only one hand. In one embodiment, tool 200 may be sized such that, in its activated state, tool 200 has a height 288 of about two inches (as measured, for example, from body contact face 248 to an outer face 292 of plate 210), and a length 290 of about four inches (as measured, for example, from a first extent 294 of side surface 252 to a second extent 296 of side surface 252). As such, tool 200 is sized for easier handling when removing fasteners from elevated locations, and is sized to fit within smaller spaces (e.g., interior space 146) for pulling harder-to-reach fasteners (e.g., fasteners 138). In other embodiments, tool 200 may not be sized for handheld operation as set forth above (i.e., some embodiments of tool 200 may be sized such that tool 200 cannot be coupled to, and decoupled from, an associated fastener 138 in an elevated position using only one hand).

Because tool 200 has such a small size in the exemplary embodiment (e.g., because cylinders 254 are sized smaller), the pump connected to tool 200 may be a hand-actuated pump, not an electrically actuated pump, to facilitate enabling more precise control over the amount of working fluid supplied to cylinders 254, thereby inhibiting the over-pressurization of cylinders 254. For example, in one embodiment, tool 200 may be operable only with a pump having a pressure rating of less than about seven hundred bars. Suitably, the operator holding tool 200 may actuate the associated pump, or another operator may actuate the associated pump. For example, one operator may repeatedly insert tool 200 into, and remove tool 200 from, interior space 146 for pulling one fastener 138 after the next, while another operator selectively hand-actuates the associated pump, thereby facilitating a more rapid process by which fasteners 138 are pulled from wall 130 of casing 110 about inner ring 124 in a shorter period of time. In other embodiments, the pump may be any suitable pump, including an electrically actuated pump. Moreover, in lieu of utilizing a pneumatic or hydraulic mechanism for displacing puller 204 relative to body 202 as set forth above, other embodiments of tool 200 may utilize a suitable arrangement of gears/levers that facilitates displacing puller 204 relative to body 202 when removing and/or inserting fasteners 138.

The methods and systems described herein facilitate the removal of fasteners in a less laborious and less time-consuming manner. The methods and systems also facilitate removing fasteners that are accessible only in smaller openings that are more difficult to reach. For example, the methods and systems facilitate minimizing the amount of time needed to pull dowel pins that retain inlet guide vanes in a turbine assembly. As such, the methods and systems facilitate reducing the amount of time needed to conduct an inspection, or to perform routine service, on the compressor of a turbine assembly. The methods and systems thereby facilitate reducing the amount of time that a turbine assembly is offline during inspection and/or servicing, which in turn facilitates reducing the overall cost associated with inspecting and/or servicing the turbine assembly.

Exemplary embodiments of methods and systems for removing fasteners are described above in detail. The methods and systems described herein are not limited to the specific embodiments described herein, but rather, components of the systems and steps of the methods may be utilized independently and separately from other components and steps described herein. For example, the methods and systems described herein may have other applications not limited to practice with turbine assemblies, as described herein. Rather, the methods and systems described herein can be implemented and utilized in connection with various other industries.

While the invention has been described in terms of various specific embodiments, those skilled in the art will recognize that the invention can be practiced with modification within the spirit and scope of the claims.

What is claimed is:

1. A tool for removing a fastener from an aperture defined in a component surface, said tool comprising:

a body comprising a first face configured to contact the component surface, a second, opposed face, and a sidewall extending between said first face and said second face, said sidewall defining a recessed passage of said body, said body further comprising a cylinder positioned between said first face and said second face and within said sidewall, said cylinder configured to be pressurized between an active state and an inactive state; and a puller coupled to said body, said puller comprising:

a plate;

an arm extending within said recessed passage from said plate to a distal end, said distal end comprising a pair of laterally extending prongs configured to engage an installed fastener within an open-ended slot defined between said prongs; and a piston inserted into said cylinder of said body and extending to said plate, wherein, when said cylinder is in the inactive state, said plate is in a first position with respect to said second face and said distal end is substantially aligned with said first face, and wherein, when said cylinder is pressurized to the active state, said piston is displaced within said cylinder to move said plate out of the first position away from said second face and displace said arm relative to said body to cause removal of the fastener, and wherein said sidewall is positioned to guide said arm within said recessed passage as said plate is moved relative to said second face.

2. A fastener removal tool in accordance with claim 1, wherein said body comprises an additional cylinder, said puller comprises an additional piston, wherein said piston and said additional piston are each inserted into a respective one of said cylinder and said additional cylinder, and wherein said arm is integrally formed with said plate and is both spaced from and positioned between said piston and said additional piston.

3. A fastener removal tool in accordance with claim 1, further comprising a return spring biasing said puller towards said body, wherein said piston is positioned between said arm and said return spring.

4. A fastener removal tool in accordance with claim 3, wherein said body comprises a sleeve extending between said first face and said second face, said return spring inserted into said sleeve of said body.

5. A fastener removal tool in accordance with claim 1, wherein the open-ended slot is sized for slidably engaging the fastener, and wherein a distal face of said distal end is in a coplanar relationship with said first face when said cylinder is in the inactive state.

6. A fastener removal tool in accordance with claim 1, wherein said body is generally U-shaped and comprises a first leg member, a second leg member, and a bridge member coupling said first leg member to said second leg member such that said recessed passage is defined between said first and second leg members.

7. A fastener removal tool in accordance with claim 1, further comprising a shield attached to said body and at least partially surrounding said plate when said cylinder is in both the active state and the inactive state.

8. A fastener removal tool in accordance with claim 1, wherein said tool is sized for handheld operation.

9. A method for removing a fastener using a tool, the tool including a body having a first face, a second, opposed face, a sidewall extending between the first face and the second face, the sidewall defining a recessed passage of the body, and a cylinder positioned between the first face and the second face and within the sidewall, the cylinder configured to be pressurized from an inactive state to an active state, the tool further including a puller having a plate, an arm extending within the recessed passage from the plate to a distal end, and a piston inserted into the cylinder and extending to the plate, said method comprising:

coupling the tool to an installed fastener on a component surface with the cylinder in the inactive state such that the first face contacts the component surface, a distal face of the distal end is in a coplanar relationship with the first face, the distal end engages the fastener, and the plate is in a first position with respect to the second face; and pressurizing the cylinder to the active state such that the piston is displaced within the cylinder, thereby moving the plate out of the first position away from the second face and displacing the arm relative to the body to remove the fastener, wherein the sidewall is positioned to guide the arm within the recessed passage as the arm is displaced relative to the body.

10. A method in accordance with claim 9, wherein the fastener includes a dowel pin, wherein said coupling the tool to the fastener comprises coupling the tool to the dowel pin, and wherein pressurizing the cylinder to the active state comprises removing the dowel pin.

11. A method in accordance with claim 10, wherein said coupling the tool to the fastener comprises slidably coupling the tool to a shoulder head screw of the fastener such that the shoulder head screw is engaged by an open-ended slot of the distal end.

12. A method in accordance with claim 9, wherein said pressurizing the cylinder to the active state includes pressurizing the cylinder using a hand-actuated pump.

13. A method in accordance with claim 12, wherein the hand-actuated pump is a hydraulic pump.

14. A method in accordance with claim 9, wherein said pressurizing the cylinder to the active state includes pressurizing the cylinder using a pump that is not an electrically actuated pump.

15. A method of removing an installed fastener of a gas turbine assembly using a tool including a body having a first face, a second, opposed face, a sidewall extending between the first face and the second face, the sidewall defining a recessed passage of the body, and a cylinder positioned between the first face and the second face and within the sidewall, the cylinder configured to be pressurized from an inactive state to an active state, the tool further including a puller having a plate, an arm extending within the recessed passage from the plate to a distal end, and a piston inserted into the cylinder and extending to the plate, said method comprising:

coupling the tool to the fastener within an interior space of an inner ring that supports a plurality of inlet guide vanes of the gas turbine assembly, wherein the cylinder is in the inactive state such that the first face contacts a surface of the inner ring, a distal face of the distal end is in a coplanar relationship with the first face, the distal end engages the fastener, and the plate is in a first position with respect to the second face; and pressurizing the cylinder to the active state such that the piston is displaced within the cylinder, thereby moving the plate out of the first position away from the second face and displacing the arm relative to the body to remove the fastener via the arm of the puller, wherein the sidewall is positioned to guide the arm within the recessed passage as the arm is displaced relative to the body.

16. A method in accordance with claim 15, wherein the fastener includes a dowel pin, wherein said coupling the tool to the fastener includes coupling the tool to the dowel pin, and wherein said pressurizing the cylinder to the active state further comprises removing the dowel pin.

17. A method in accordance with claim 16, wherein the fastener includes a shoulder head screw coupled to the dowel pin, and wherein said coupling the tool to the fastener further comprises coupling the arm to the shoulder head screw.

18. A method in accordance with claim 17, wherein said coupling the tool to the fastener further comprises sliding the tool along a flange of the inner ring to engage the shoulder head screw with the arm.

19. A method in accordance with claim 15, wherein pressurizing the cylinder to the active state includes pressurizing the cylinder using a hand-actuated pump.

20. A method in accordance with claim 19, wherein said coupling the tool to the fastener comprises coupling the tool via a first operator, said method further comprising actuating the pump via a second operator to pressurize the cylinder while the first operator holds the tool coupled to the fastener.

* * * * *